United States Patent [19]

Petillo

[11] 4,114,503

[45] Sep. 19, 1978

[54] DRUMSTICK

[75] Inventor: Phillip J. Petillo, Ocean, N.J.

[73] Assignee: Ambico Inc., Lynbrook, N.Y.

[21] Appl. No.: 739,494

[22] Filed: Nov. 8, 1976

[51] Int. Cl.[2] ..... G10D 13/02
[52] U.S. Cl. ..... 84/422 S
[58] Field of Search ..... 84/422 S

[56] References Cited

U.S. PATENT DOCUMENTS

| | | | |
|---|---|---|---|
| 3,146,659 | 9/1964 | Robba et al. | 84/422 S |
| 3,165,964 | 1/1965 | Stys et al. | 84/422 S |

*Primary Examiner*—Lawrence R. Franklin
*Attorney, Agent, or Firm*—Flynn & Frishauf

[57] ABSTRACT

An improved drumstick is disclosed in which a sheath made of material compatible with a user's hand and percussive engagement with a drumhead is bonded to a core made of a material having great tensile and shear strength.

13 Claims, 4 Drawing Figures

DRUMSTICK

BACKGROUND OF THE INVENTION

1. Field of the Invention

The invention pertains to drumsticks used with percussive musical instruments and pertains to drumsticks in which breaking strength is improved.

2. Description of the Prior Art

Typical drumsticks are made of a hardwood such as hickory and are shaped so as to be comfortable in the hand of the user and to percussively cooperate with a drumhead so as to set up desired vibrations therein. While conventional drumsticks are generally satisfactory, they often break during use or otherwise by accident.

Accordingly, an important object of this invention is to improve the breaking strength of drumsticks without changing the characteristics in the hands of a user or as they cooperate with a drumhead in percussive engagement.

SUMMARY OF THE INVENTION

In accordance with the preferred embodiment of this invention, improved breaking strength is achieved in a drumstick without changing usage characteristics by assembling the drumstick from a core to which an outer sheath is bonded.

In accordance with one feature of this invention, the cross-section of the core has arms and the sheath fills the voids between the arms so as to impart great strength to the resulting drumstick without changing handling characteristics.

In accordance with another feature of this invention, the core is made of a metal such as aluminum, the arms are disposed in a cross configuration and the sheath is made of wood so as to facilitate construction.

A better understanding of these and other features of the invention will be facilitated by reference to the following drawing and detailed description.

DETAILED DESCRIPTION OF THE INVENTION

Figure 1:
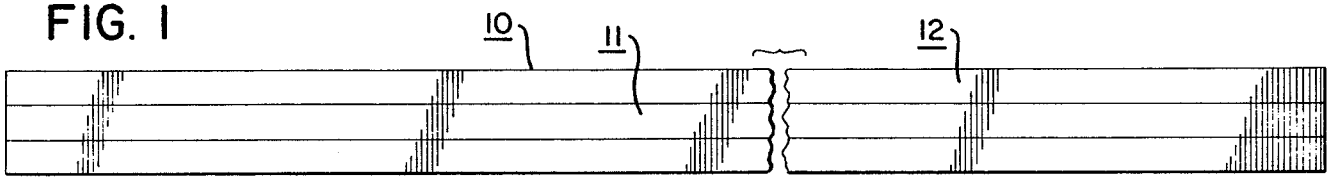
FIG. 1 is a side elevation view of a partially constructed drumstick being made in accordance with this invention.
Figure 3:
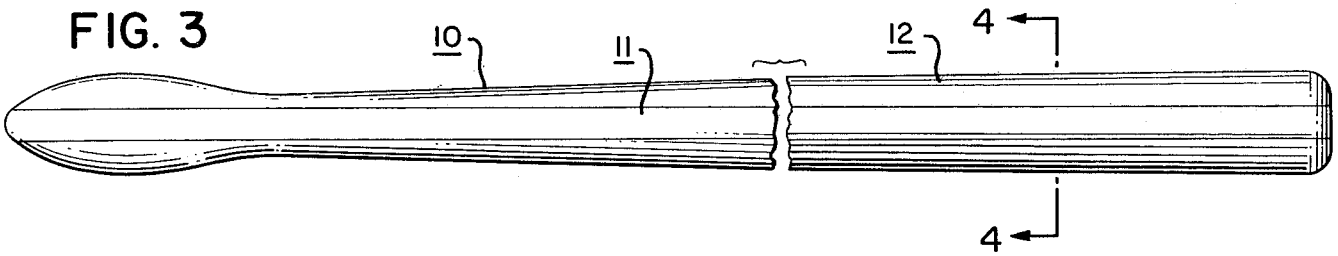
FIG. 3 is a side elevation view of the drumstick shown in FIG. 1 wherein the composite material has been shaped into finished form.
Figure 4:
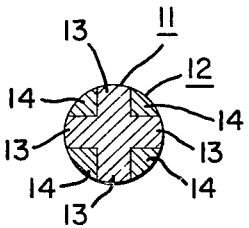
FIG. 4 is an end elevation view taken in section along the lines 4—4 of the drumstick shown in FIG. 3.

Referring to FIG. 3, a drumstick 10 is disclosed which comprises a core 11 and an outer sheath 12. As illustrated in FIG. 4, the core 11 has arms 13 when viewed in cross-section and the sheath 12 comprises segments 14 which fit in the voids between the arms 13.

Figure 2:
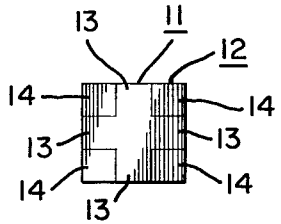
FIG. 2 is an end elevation view of the drumstick shown in FIG. 1.

In the embodiment illustrated, the core 11 is made of a material which has high tensile and shear strength, yet which is easily machined. A particular useful material which meets the necessary requirements for the core 11 is aluminum. The segments 14, as shown in FIGS. 2 and 4, are bonded to the core 11 and are advantageously made of wood such as hickory or other hard material. Various methods of bonding may be used but gluing is probably the most advantageous.

For ease of manufacture, the core 11 can, as shown in FIG. 2, have a cross-shaped configuration. Moreover, the segments 14 can be made in rectangular configuration. Construction is commenced by bonding the segments to the arms 13. Thereafter, as illustrated by FIG. 3, the composite assembly is turned as on a lathe until the proper drumstick configuration is reached.

In the embodiment illustrated, the core 11 has been cross-shaped. Other configurations will be equally useful; i.e., a Y-shape. Moreover, the materials from which the core 11 and segments 14 are made can vary; i.e., steel, magnesium, plastic or other material as desired.

In summary, an improved drumstick has been disclosed which retains the characteristics of a wooden drumstick, but which exhibits improved breaking strength. While only one embodiment has been disclosed, it is merely illustrative of the principals of the invention and other embodiments falling within the scope of the invention will readily occur to others skilled in the art.

What I claim is:

1. An elongated drumstick comprising:

a core having extending arms when viewed in cross-section, said arms extending along at least a substantial portion of the length of the drumstick; and an outer sheath filling in the voids between adjacent ones of said arms and extending to the outer surface of the drumstick;

said core being made of a material having a tensile and shear strength greater than that of said sheath and said sheath being bonded to said core and being made of a material compatible with the hand of a user and adapted to cooperate with a drumhead so as to set up appropriate vibrations therein when the two are percussively engaged.

2. A drumstick in accordance with claim 1 wherein said core is made of a metal.

3. A drumstick in accordance with claim 1 wherein said arms extend substantially symmetrically with substantially equal angles between respective adjacent arms.

4. A drumstick in accordance with claim 1 wherein said arms are disposed in a symetrical cross.

5. A drumstick in accordance with claim 1 wherein said arms are made of aluminum and said sheath comprises strips of hardwood bonded to said core.

6. A drumstick in accordance with claim 1 wherein said core is made of a metal, and said sheath comprises strips of hardwood bonded to said core.

7. A drumstick in accordance with claim 1 wherein said arms of said core extend to the outer surface of the drumstick.

8. A drumstick in accordance with claim 7 wherein said sheath comprises a major portion of the outer peripheral surface of the drumstick when viewed in cross-section, and the portions of said core which extend to the outer surface of the drumstick comprise a minor portion of the outer peripheral surface of the drumstick when viewed in cross-section.

9. A drumstick in accordance with claim 8 wherein said core is made of a metal and said sheath comprises strips of hardwood bonded to said core.

10. A drumstick in accordance with claim 9 wherein said metal is aluminum.

11. A drumstick in accordance with claim 9 wherein said metal is magnesium.

12. A drumstick in accordance with claim 1 wherein said core is made of magnesium and said sheath comprises strips of hardwood bonded to said core.

13. A drumstick in accordance with claim 1 wherein said sheath comprises a plurality of strips of material bonded to said core between a respective pair of arms, said strips being separated from each other.

* * * * *